US005683236A

United States Patent [19]

Harrison et al.

[11] Patent Number: 5,683,236

[45] Date of Patent: Nov. 4, 1997

[54] ANTI-REVERSE ROTATION VALVE FOR SCROLL COMPRESSOR

[75] Inventors: Mark W. Harrison; Peter A. Kotlarek, both of Onalaska, Wis.; Charles A. Singletary, Whitehouse; John Kenneth Wollitz, Tyler, both of Tex.

[73] Assignee: Alliance Compressors, Tyler, Tex.

[21] Appl. No.: 619,316

[22] Filed: Mar. 21, 1996

[51] Int. Cl.[6] ..... F04C 18/04; F04C 29/00; F04C 29/02; F16K 15/02

[52] U.S. Cl. ..... 418/55.1; 418/188; 418/270; 418/DIG. 1; 137/513.3; 137/533.17

[58] Field of Search ..... 418/55.1, 188, 418/270, DIG. 1; 137/513.3, 533.17, 533.19, 538

[56] References Cited

U.S. PATENT DOCUMENTS

| | | | |
|---|---|---|---|
| 487,064 | 11/1892 | Clayton | 137/533.19 |
| 3,420,273 | 1/1969 | Greer | 137/513.3 |
| 4,357,132 | 11/1982 | Kousokabe | 418/55.5 |
| 4,781,542 | 11/1988 | Ozu et al. | 417/369 |
| 4,846,640 | 7/1989 | Nishida et al. | 418/55.6 |
| 4,904,165 | 2/1990 | Fraser, Jr. et al. | 417/312 |
| 4,911,620 | 3/1990 | Richardson, Jr. et al. | 418/55.5 |
| 4,929,160 | 5/1990 | Inoue | 418/55.2 |
| 5,040,952 | 8/1991 | Inoue et al. | 417/312 |
| 5,224,848 | 7/1993 | Noburu et al. | 418/55.1 |
| 5,421,708 | 6/1995 | Utter et al. | 418/55.6 |

FOREIGN PATENT DOCUMENTS

| | | | |
|---|---|---|---|
| 495754 | 9/1950 | Belgium | 137/533.19 |
| 576301 | 5/1933 | Germany | 137/533.17 |
| 2202547 | 8/1973 | Germany | 137/538 |
| 2-227583 | 9/1990 | Japan | 418/188 |
| 4-325790 | 11/1992 | Japan | 418/55.1 |
| 252022 | 9/1969 | Russian Federation | 137/513.3 |

*Primary Examiner*—John J. Vrablik
*Attorney, Agent, or Firm*—Michael E. Martin

[57] ABSTRACT

A scroll-type refrigeration compressor has a gas-liquid mixture discharge passage extending through the driver scroll drive shaft for discharging refrigerant gas and entrained lubricant into a high pressure chamber in the compressor housing. An anti-reverse rotation valve is connected to the distal end of the drive shaft and includes a valve housing with radially extending discharge ports and a closure member movable to prevent reverse flow of high pressure gas to the scroll compression chambers to prevent reverse rotation on compressor shutdown. A pressure equalization port may be formed in the valve closure member, valve housing or the distal end of the drive shaft to allow slow bleed down of pressure from the high pressure side to the low pressure side to minimize starting torque of the drive motor. The valve may be formed from a tubular metal housing and having a plug-type closure member slidably disposed therein with the housing being press fitted in a counterbore in the end of the shaft. A gas-liquid separation baffle may be disposed around the valve housing for assisting in gas-liquid separation after the mixture is discharged from the valve housing. Valve embodiments include a housing and closure member arrangement supported such that rotation of the drive shaft exerts a centrifugal force on the closure member to bias it toward an open position. Centrifugal force responsive valves may be moved to their closed position by a biasing spring, pressure forces and gravity forces acting thereon, respectively.

14 Claims, 4 Drawing Sheets

ANTI-REVERSE ROTATION VALVE FOR SCROLL COMPRESSOR

FIELD OF THE INVENTION

The present invention pertains to an anti-reverse rotation check valve for preventing reverse flow of refrigerant fluid through the scroll compression chambers of a scroll compressor and to aid in separating compressed refrigerant gas from entrained compressor lubricant.

BACKGROUND

Scroll-type fluid handling apparatus have become widely used in various gas compression and expansion applications. One particularly advantageous use of scroll compressor apparatus is in vapor compression refrigeration systems. A preferred arrangement of scroll-type compressors for vapor compression refrigeration systems is characterized by an electric motor driven driver scroll member which is cooperable with a driven or idler scroll to form cooperating variable volume compression chambers for compressing refrigerant gas or vapor. The scroll apparatus is particularly tolerant of liquid entrained in the refrigerant gas or vapor and a liquid lubricant is typically entrained in the gas to aid in sealing the compression chambers and to lubricate the interengaging scroll members as well as other parts of the apparatus.

One particular configuration of a compressor of the above-mentioned type provides for the driver and driven scroll members to be disposed in a closed housing or shell having one or more intermediate wall or housing sections which define a low pressure chamber in which the scroll members are disposed and which is in communication with an inlet conduit for inflowing refrigerant gas. The driver scroll is connected to a vertically oriented drive shaft which projects through a housing wall having a suitable shaft support bearing thereon and is connected to the rotor of an electric drive motor. The motor is disposed in a chamber of the housing which is exposed to high pressure discharge gas which passes from the cooperating scroll members through an elongated passage in the drive shaft and is discharged from a distal end of the drive shaft into a chamber which allows separation of any entrained liquid, primarily oil lubricant, from the high pressure gas. High pressure gas is then discharged from the compressor housing to a refrigerant circuit, for example.

When the compressor drive motor is shut off, the high pressure gas in the compressor discharge chamber will flow beck into the drive shaft passage and the compression chambers of the cooperating scroll members to cause the scroll members to act as an expander or motor and rotate in the opposite direction. This action may occur with a lack of adequate lubricating oil present in the scroll chambers to properly lubricate the cooperating interengaged scroll members. Moreover, if the compressor is stopped only momentarily in its operating cycle and if the drive motor is then rotating in the opposite direction, the motor, upon reenergization, may continue to rotate in the same direction. This characteristic is encountered particularly with single phase alternating current induction motors. Reverse rotation of the compressor under power cannot, of course, be tolerated.

A solution to the above-mentioned problem can be provided by interposing a one-way or so-called check valve in the flow path of gas discharged from the compression chambers. U.S. Pat. No. 5,040,952 issued Aug. 20, 1991 to Inoue et al. discloses a check valve disposed across the distal end of the driver scroll drive shaft to prevent the backflow of pressure gas into the scroll compression chambers. However, improvements in check valves operably connected to the high pressure passage in the driver scroll drive shaft have been sought.

One improvement which is considered desirable, and which has been a longstanding problem in scroll compressors which entrain lubricant and occasional slugs of liquid refrigerant in the discharge gas flow stream, pertains to providing for sufficient separation of the lubricant fluid to prevent its carryover into the refrigerant circuit at the discharge or high pressure side of the compressor. U.S. Pat. No. 5,421,708 issued Jun. 6, 1995 to Robert E. Utter et al. and assigned to the assignee of the present invention describes one improvement in gas and lubricant oil separation means in a compressor of the general type described herein. However, it has been considered advantageous in accordance with the present invention to provide an anti-reverse flow check valve for the refrigerant gas which can also assist in separating the gas from entrained liquid after discharge from the scroll compression chambers.

It has also been deemed desirable to provide an anti-reverse rotation valve which can be economically fabricated, easily attached to the distal end of the driver scroll drive shaft, is reliable in operation, and provides for slow pressure equalization between the high pressure compression chamber and the low pressure chamber in which the scroll members are disposed. It is to these ends, inter alia, that the present invention has been developed.

SUMMARY OF THE INVENTION

The present invention provides an improved reverse flow control or so-called anti-reverse rotation valve for a scroll compressor to prevent substantial reverse flow of compressed refrigerant gas to avoid reverse rotation of the compressor rotors.

In accordance with one important aspect of the present invention, an anti-reverse rotation or reverse flow control valve is provided which is disposed in a valve housing connected to or forming part of a motor drive shaft for a scroll compressor and disposed at a distal end of the drive shaft to prevent reverse flow of compressed refrigerant fluid and to aid in separating compressed refrigerant gas from entrained liquid, such as lubricating oil and/or liquid refrigerant, as the fluid mixture passes through the valve. The valve is advantageously located in a chamber formed by a portion of the compressor housing which redirects the flow of compressed refrigerant and entrained lubricating oil in such a way as to maximize the separation of liquid from the compressed refrigerant gas.

In accordance with another aspect of the present invention, a reverse flow control valve is provided for preventing substantial reverse rotation of the scroll members of a scroll-type compressor wherein the valve includes a control fluid flow port which allows gradual flow of high pressure gas beck through the compression chambers to equalize the gas pressure between a high pressure side of the compressor and a low pressure or inlet gas side to minimize compressor starting torque.

In accordance with still another aspect of the present invention, a reverse flow control valve is provided for a scroll-type compressor, which valve is supported on or connected directly to the compressor driver scroll drive shaft and which is responsive to rotation of the shaft to generate forces acting on a valve closure member to move the valve to an open position to provide for flow of compressed gas through a passage in the drive shaft and to be discharged from the compressor unit. The reverse flow control valve is responsive to stopping of the drive shaft to move to a closed position to prevent substantial and rapid backflow of pressure gas through the compression chambers so as to eliminate the tendency for the compressor scroll rotor members to rotate in the reverse direction.

The present invention further contemplates the provision of a reverse flow control valve arrangement for a scroll type compressor and the like which includes a flow deflector or baffle interposed in a gas-liquid separation chamber to enhance separation of gas from liquid being discharged through the compressor driver scroll drive shaft.

Those skilled in the art will further appreciate the above-mentioned features and advantages of the present invention together with other superior aspects thereof upon reading the detailed description which follows in conjunction with the drawing.

DESCRIPTION OF THE PREFERRED EMBODIMENTS

Figure 1:
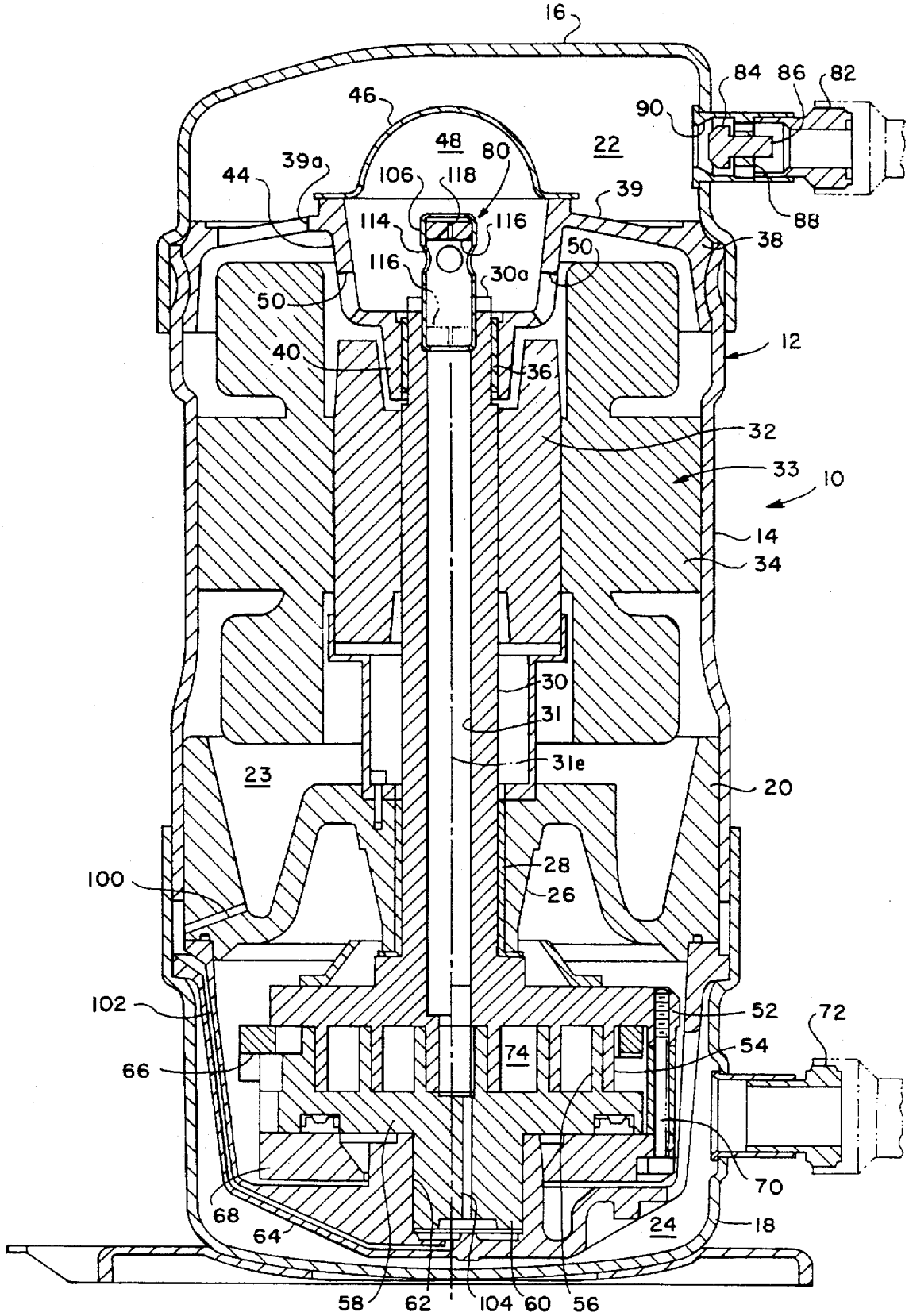
FIG. 1 is a vertical central section view of a scroll-type refrigeration compressor including an anti-reverse rotation valve arrangement in accordance with the invention.

In the description which follows, like parts are marked throughout the specification and drawing with the same reference numerals, respectively. The drawings are not necessarily to scale in the interest of clarity and conciseness.

Referring to FIG. 1, there is illustrated a scroll-type compressor, generally designated by the numeral 10, and of a type particularly adapted for use in vapor compression refrigeration system. The compressor 10 is characterized by a vertically extending outer housing or shell 12 which includes a generally cylindrical intermediate shell section 14, an upper shell head member 16 and a lower shell head member 18. The shell 12 defines an enclosure for the working parts of the compressor 10 and the interior of the shell is divided by a housing section 20 into an upper, high pressure chamber 22 and a lower, low pressure chamber 24. The intermediate housing section 20 includes a hub portion 26 having a suitable bore for supporting a bearing 28 for a rotatable vertically extending drive shaft 30. The shaft 30 is suitably secured to a rotor 32 of a single phase alternating current induction motor 33 which includes a stator member 34. The drive shaft 30 is also supported at its upper end in a sleeve type bearing 36 which is supported by an upper support housing member 38 having a cylindrical web 39 connected to a hub portion 40 for supporting the bearing, as shown. The hub 40 is connected to a generally cylindrical, enlarged diameter housing part 44 which, together with a generally hemispherical cap member 46 suitably secured thereto, forms a compressed gas-liquid receiving and separation chamber 48. Suitable spaced apart ports 50 are formed in the housing part 44 to communicate gas and liquid from the chamber 48 into the high pressure chamber 22. The web 39 includes one or more ports **39*a*** formed therein.

The drive shaft 30 is integrally formed with a driver scroll member 52 having axially depending scroll wraps 54 which are cooperable with wraps 56 formed on a driven or idler scroll member 58. The idler scroll member 58 includes a depending cylindrical stub shaft part 60 which is journalled in a bearing 62 formed by a lower, stationary housing 64 disposed in the chamber 24. The particular compressor 10 illustrated is of the so-called co-rotating type wherein both the driver scroll 52 and the driven or idler scroll 58 rotate and orbit relative to each other in a known way through a drive connection comprising an Oldham type coupling 66. The idler scroll 58 is held in engagement with the driver scroll 52 in a known way by a suitable, generally cylindrical pressure plate 68 secured to the driver scroll by plural threaded pins 70, one shown.

Low pressure gas enters the chamber 24 through a suitable inlet conduit and fitting 72, is compressed in compression chambers 74 formed between the scroll wraps 54 and 56 and is discharged at high pressure through an elongated passage 31 formed in the drive shaft 30. A mixture of compressed gas and entrained liquid, such as lubricating oil and/or slugs of liquid refrigerant, is discharged from the distal end 30a of shaft 30 through a unique anti-reverse rotation valve, generally designated by the numeral 80. The shaft 30 may have a transverse tool slot **30*b* formed in the distal end 30*a***, as shown.

Compressed gas entering the chamber 48 from the valve 80 is substantially separated from any entrained liquid as it flows out through ports 50 and is further separated as the gas tends to flow upward in the chamber 22 through ports **39*a* into the portion of the chamber defined by the shell head member 16 and then flows out of the shell 12 by way of a discharge conduit and fitting 82. The discharge conduit and fitting 82 includes a reverse flow preventing check valve disposed therein comprising a plug type closure member 84 supported on a central elongated shaft part 86 which is supported for sliding movement on a ported hub SS. The closure member 84 is engageable with a suitable seat 90 to prevent reverse flow of high pressure refrigerant gas or the like from the refrigerant system, not shown, back into the high pressure chamber 22**.

Liquid oil lubricant separated from gas in chamber 48 and chamber 22 flows, substantially under forces of gravity, down through motor 33, into a reservoir portion 23 defined by the housing section 20. Lubricant oil then flows through suitable passages 100 and 102, for example, formed in the housing section 20 and housing section 64, respectively, to lubricate the bearing 62. A passage 104 is formed in the idler scroll shaft 60 for conducting some lubricant into the compression chambers 74 to form a seal between the scroll wraps 54 and 56 and to reduce the work of compression. This liquid is recirculated through passage 31 and into chamber 22 with the compressed gas. The aforedescribed features of the compressor 10, save the anti-reverse rotation valve 80, are known to those skilled in the art and further description is not believed to be necessary to enable one to practice the present invention. Suffice it to say that the present invention provides an improved anti-reverse rotation valve arrangement for a scroll-type compressor which is particularly advantageously used in compressors which entrain a lubricating and sealing liquid with the gas being compressed by the interacting scrolls. The compressor 10 is also exemplary in regard to the arrangement of the idler scroll which co-rotates with the driver scroll.

Figure 2:
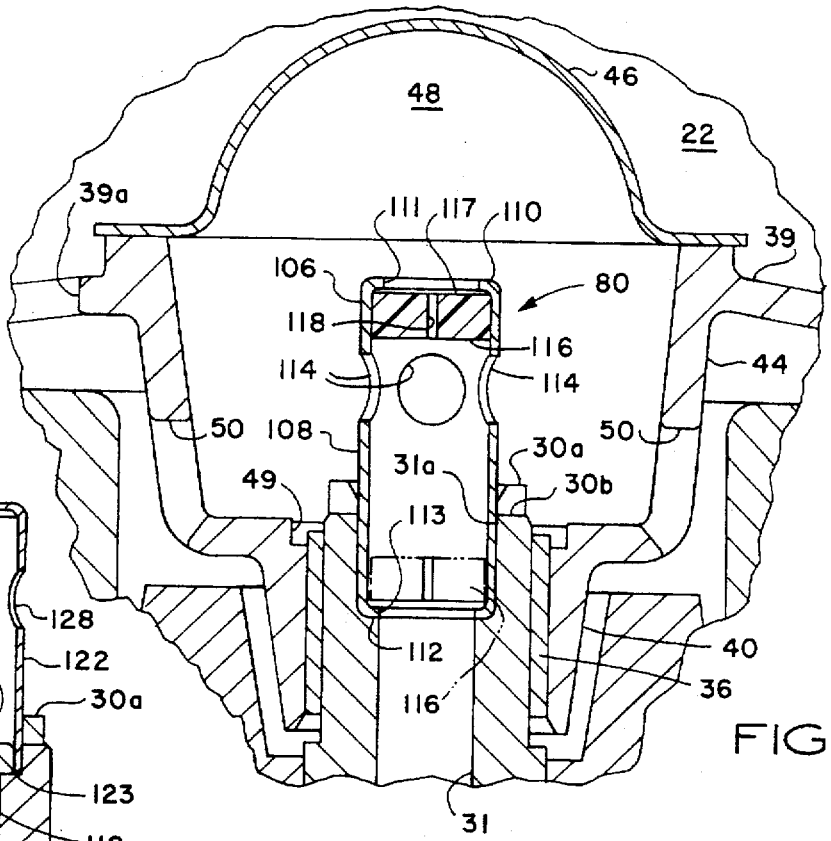
FIG. 2 is a detail section view taken from the same plane as the view of FIG. 1 and showing the anti-reverse rotation valve arrangement on a larger scale.

Referring further to FIG. 1 and also, primarily, to FIG. 2, the anti-reverse rotation valve 80 is advantageously supported on the distal end 30*a* of the drive shaft 30 and is characterized by an elongated, generally cylindrical tubular valve housing 106 having a cylindrical sidewall 108 and transverse end wall portions 110 and 112. The transverse end wall portions 110 and 112 may comprise die formed end portions of a generally cylindrical tube to form reentrant edges which are delimited by circular openings 111 and 113. The valve housing 106 is suitably disposed, preferably by a moderate interference fit, in a shaft counterbore 31*a* coaxial with the passage 31 and contiguous therewith.

The valve 80 includes a plurality of fluid discharge ports 114 extending through the housing wall 108 and circumferentially spaced about the circumference of the housing 106. A closure member 116 is disposed in the housing 106 and comprises a generally cylindrical plug member slidably disposed for movement between an open position shown in FIG. 2 and a closed position shown by the alternate position lines in FIGS. 1 and 2. The closure member 116 may be formed of a suitable polymer material such as an injection molded or machined polyether ether ketone, polyamide amid or polyphenyl sulfide polymer, for example. The closure member 116 is provided with a passage 118 extending therethrough which permits gradual pressure equalization between the chambers 22 and 24 when the closure member 116 is in the closed position and substantially preventing rapid backflow of high pressure gas from chamber 22 into the scroll compression chambers 74. When the compressor motor 33 is shut off and the shaft 30 stops rotating, the difference in pressures in the chambers 22 and 24 will, without the valve 80, cause rapid backflow of high pressure gas through the passage 31 and the compression chambers 74 causing the drive shaft 30 and the scroll members 52 and 58 to rotate in a reverse direction, thus operating as an expander or motor. If the compressor 10 has been shut off only momentarily, such as due to interruption of the power supply or adjustment of the refrigerant system controls, a single phase induction motor when rotating in the opposite direction will, upon reenergization, continue to operate in that direction thus causing the compressor 10 to operate as an expander and in a totally unwanted mode.

When the compressor 10 is operating in a normal mode, the flow of gas and entrained liquid through the passage 31 will move the valve closure member 116 to the open position shown in FIG. 2. However, if the compressor stops operating, due to the vertical orientation of the shaft 30 and, to some extent, pressure forces acting on the closure member 116, the closure member will move to the closed position shown by the alternate position lines and in engagement with a seat formed by the end wall 112 to substantially block the flow of gas from chambers 22 and 48 in a reverse direction through the passage 31. A pressure differential may occur across the face 117 of the closure member 116 also, if the flow area of opening 111 exceeds the collective flow areas of the ports 114, for example. Thus, the closure member 116 will rapidly move to a closed position to substantially prevent rapid flow of fluid in a reverse direction through passage 31. On the other hand, it is desirable to equalize the fluid pressures in the chambers 22 and 24 to minimize starting torque imposed on the drive motor 33. Accordingly, the passage 118 is provided and is sized to permit metered flow of compressed gas back through passage 31 and chamber 74 without causing rotation of the scrolls 52 and 58. The clearance between the scroll wraps 54 and 56 is sufficient to allow some leakage of gas so that pressure is equalized between the chambers 22 and 24 in a relatively short time. In this way, when the compressor 10 is restarted, a relatively low starting effort is imposed on the motor 33.

One particular advantage of the unique anti-reverse rotation valve 80 resides in the arrangement of the ports 114 which cause the gas-liquid mixture being discharged into the chamber 48 to be directed generally radially outwardly against the enlarged diameter wall portion 44 of the housing 38. Moreover, the rotation of the closure valve 80 with the shaft 30 and the radial orientation of ports 114 will also tend to effect separation of gas from liquid in the chamber 48. Lubricant separated from the compressed gas in chamber 48 will also advantageously lubricate bearing 36 and an annular collection channel 49 is provided in the hub part 40, as illustrated in FIG. 2 for collecting such lubricant. Additional lubricant will flow out of the ports 50 and cascade down between the rotor 32 and stator 34 and collect in the reservoir 23 before returning to chamber 24 as described above.

The housing 106 is advantageously formed of relatively thin walled steel tubing or the like and may be die formed to roll the ends of the tubing to form the end walls 110 and 112. At least one of the end walls 110 and 112 is formed after the closure member 116 is disposed in the interior of the housing 106 and freely slidable therein. The housing 106 is also dimensioned to be a moderate interference fit in the counterbore 31*a* to facilitate easy assembly of the valve 80 to the shaft 30.

Figure 3:
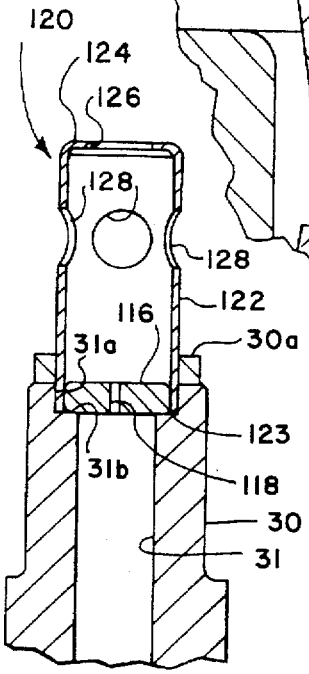
FIG. 3 is a detail section view showing a first alternate embodiment of an anti-reverse rotation valve in accordance with the invention.

Referring briefly to FIG. 3, a first alternate embodiment of an anti-reverse rotation valve in accordance with the invention is illustrated and generally designated by the numeral 120. The valve 120 is similar in most respects to the valve 80 and includes a generally tubular valve housing 122 which is formed at its upper end to have a transverse machined or die formed end wall portion 124 and a circular opening 126 formed therein. Plural, circumferentially spaced, radially extending discharge ports 128 are formed in the housing 122 and are similar to the ports 114. A closure plug member 116 is disposed in slidable relationship within the housing 122 for operation in the same manner as the closure plug 116 operates in conjunction with the housing 106, except that the housing 122 has a lower distal end 123 without a reentrant edge. Thus, the shaft 30 is modified to have a counterbore 31*a* sufficiently larger in diameter than the passage 31 to form a transverse face 31*b* in the distal end of the shaft and serving as a seat for engagement by the closure plug 116. Accordingly, the valve 120 may also be assembled by placing the closure plug 116 within the housing 122 after the transverse end wall 124 has been formed and then press fitting the housing 122 into the counterbore 31*a*.

Figure 4:
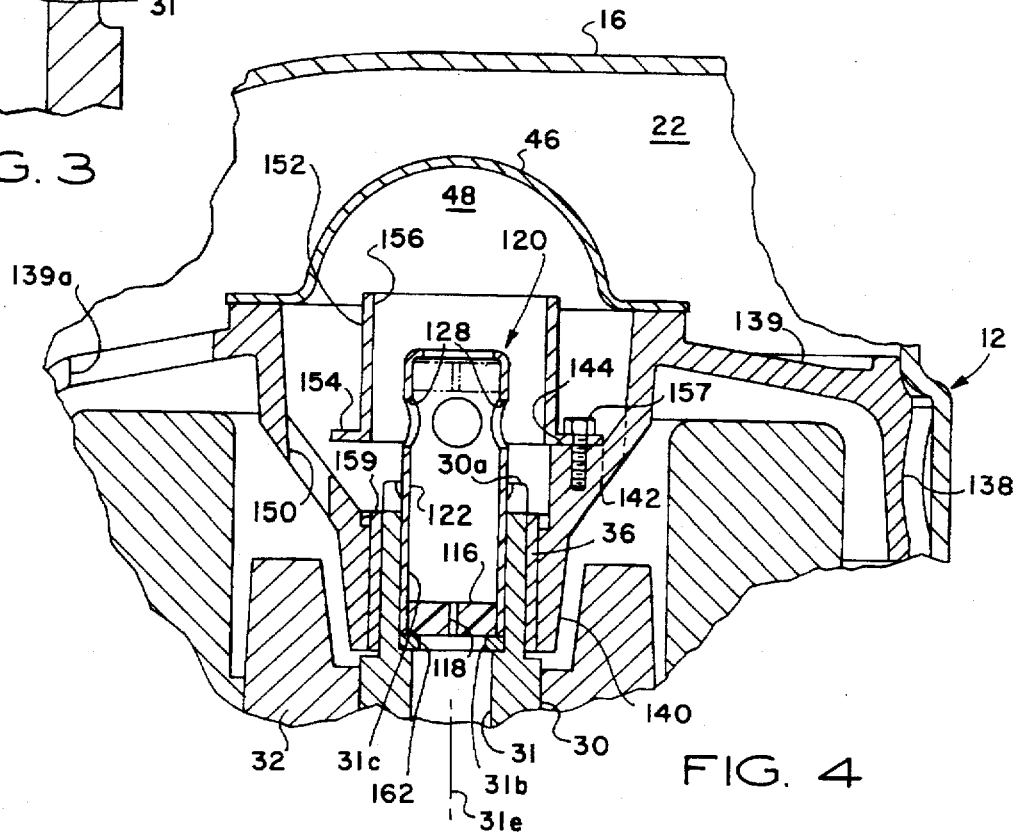
FIG. 4 is a section view similar to FIG. 2 showing a second alternate embodiment of an anti-reverse rotation valve and further showing a unique gas-liquid separation baffle arrangement.

FIG.4 shows a further modification of an arrangement of an anti-reverse rotation valve and a gas-liquid separation baffle. In the arrangement of FIG. 4, a modified upper support housing member 138 is disposed in the shell 12 in place of the housing 38. The housing 138 includes a transverse web 139 having one or more ports 139*a* formed therein and supporting a bearing hub 140 for bearing 36. Housing 138 also includes an enlarged diameter hub portion 142 having a transverse face 144. The housing 138 also supports a cover 46 to define a gas-liquid mixture receiving and separation chamber 48. Generally vertically downwardly facing ports 150, one shown, are formed in the enlarged diameter hub portion 142 of the housing 138. The housing 138 supports a generally cylindrical tubular baffle 152 within the chamber 48. The baffle 152 includes a circumferential flange 154 and a generally cylindrical tubular wall part 156 extending substantially coaxial with the axis of the shaft 30. Suitable threaded fasteners 157, one shown, are engaged with circumferential flange 154 and hub portion 142 to support the baffle 152 on the face 144, as illustrated. The baffle 152 is disposed around the anti-reverse rotation valve 120 whose housing 122 is press fitted in a counterbore 31*c* in the shaft 30. In the arrangement illustrated in FIG. 4, the valve housing 122 engages a generally circular ring seat member 162 interposed between the end of the housing 122 and a transverse shoulder 31*b* formed between the counterbore 31*c* and the passage 31. The closure member 116 is operable to engage the seat 162 to substantially prevent rapid reverse flow of the gas liquid mixture through the passage 31. The ring seat 162 may be advantageous in compressor arrangements wherein the counterbore 31*c* cannot be much larger in diameter than the bore or passage 31 thereby not providing a sufficient seating surface on shoulder 31*b* for the closure member 116. The seat 162 may be loosely fitted in the counterbore 31*c* and the housing 122 may be forced fitted in the counterbore to retain the seat in its working position.

The operation of valve 120 is substantially the same as the valve 80 and, in the arrangement shown in FIG. 4, a gas-liquid mixture is discharged transversely with respect to the axis of rotation 31*e* of shaft 30 to impinge directly on the baffle wall 156 thereby further effecting separation of gas and liquid within the chamber 48 before flow of both of these fluids occurs through ports 150. As shown in FIG. 4, the ports 128 open directly toward the baffle wall 156 and the arrangement of the ports 150 is such that a substantial change in direction of the gas-liquid mixture flowstream occurs before entering chamber 22, thereby enhancing the separation of gas and liquid without material friction pressure loss in the gas flowstream leaving the passage 31. Oil draining from the baffle wall 156 also advantageously collects in a generally annular reservoir chamber 159 formed between the hub portions 140 and 142 to provide superior lubrication of bearing 36. As chamber 159 fills with separated liquid, excess liquid overflows through ports 150, as mentioned above, and down through motor 33, in the same manner as the embodiment shown in FIGS. 1 and 2. Accordingly, the valve 120, and the valve 80 provide superior separation of gas from liquid as a mixture of same enters the chamber 48, which separation is further enhanced by the baffle 152 and the general arrangement of the structure defining the chamber 48.

FIGS. 5 through 8 show further alternate embodiments of anti-reverse rotation valves which are responsive to centrifugal forces acting thereon to move to an open position in addition to the urging of pressure fluid forces. The valves illustrated in FIGS. 5 through 8 are also responsive to a cessation in rotation of the compressor driver scroll drive shaft to move to a closed position. The unique valves shown in FIGS. 5 through 8 provide certain advantages in that centrifugal forces acting on the valves tend to move them to an open position during operating conditions when gas forces acting on the valves may tend to move them in another direction. At least one of the valves may be biased in a closed position by spring means, once rotation of the drive shaft has ceased.

Figure 5:
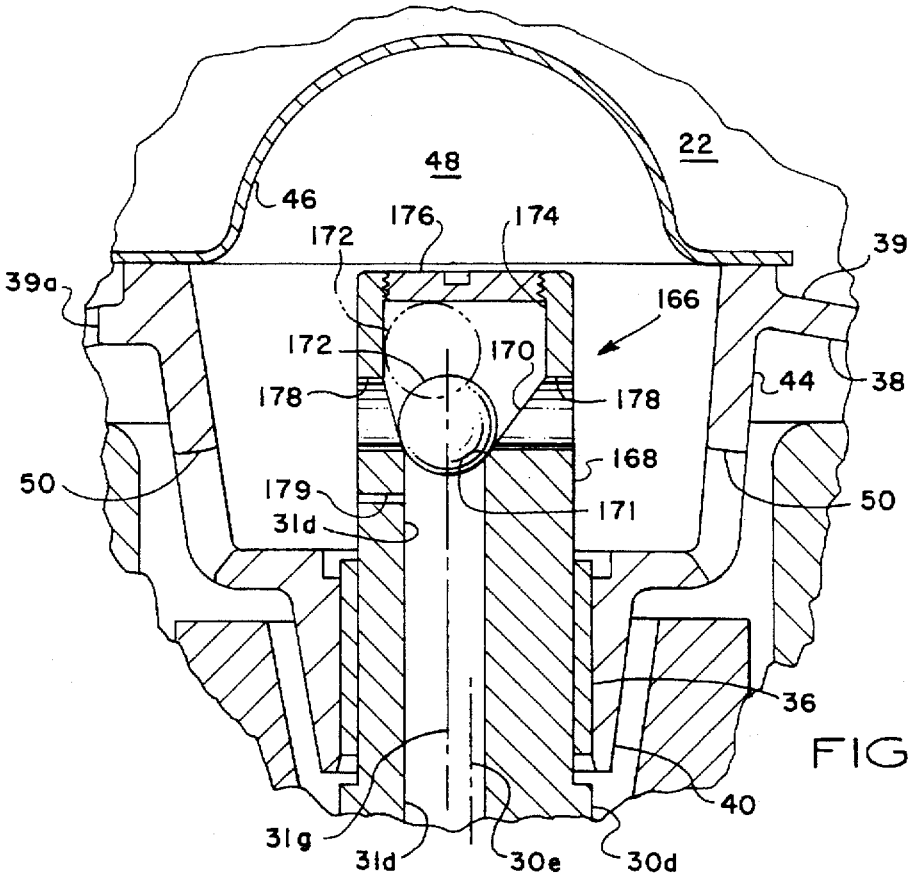
FIG. 5 is a detail section view showing a third alternate embodiment of an anti-reverse rotation valve.

Referring to FIG. 5, there is illustrated a third alternate embodiment of the invention comprising an anti-reverse rotation valve 166 including a housing portion 168 forming an integral part of a modified drive shaft 30*d*. The drive shaft 30*d* includes a longitudinal passage 31*d* for receiving fluid from compression chambers 74, and which includes at least a portion whose central axis 31*g* is offset laterally from a central axis of rotation 30*e* of the shaft 30*d*. The shaft extension and housing portion 168 includes a generally conical bore 170 intersecting the passage 31*d* to form a seat 171 for a ball-type closure member 172. The closure member 172 is moved from a position shown engaged with the seat 171 to an open position in a generally cylindrical chamber 174 formed in the shaft extension portion 168 above the conical bore 170. The chamber 174 is closed by a removable end cap 176 which may be threadedly engaged with the shaft extension 168, as shown. Transverse, radially extending gas-liquid discharge ports 178 intersect the bore 170 and communicate with the chamber 174 as well as the passage 31*d* when the closure member 172 is disposed off of its seat. In response to rotation of the shaft 30*d*, a centrifugal force is exerted on the closure member 172 due to its lateral offset position with respect to the axis of rotation 30*e* of the shaft to cause the closure member to move to the alternate, valve open position shown in FIG. 5. The closure member 172 is also movable to its open position by pressure forces acting thereon from fluid flowing through passage 31*d*. Accordingly, centrifugal forces as well as pressure forces move the valve closure member 172 to an open position and pressure forces as well as gravity forces will cause the valve to reseat itself on the seat 171 when the shaft 30*d* ceases rotation. Gradual pressure equalization between chambers 22 and 24 is provided by a restricted passage 179 formed in the shaft extension 168 and communicating chamber 48 with passage 31*d*, as illustrated.

Figure 6:
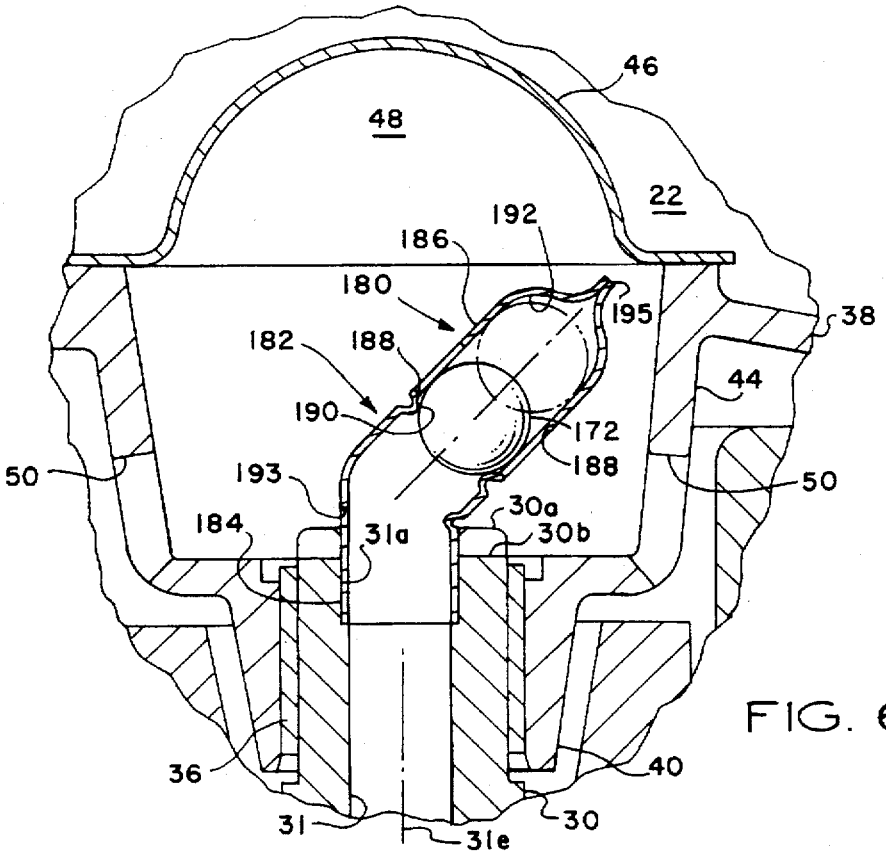
FIG. 6 is a detail section view showing a fourth alternate embodiment of an anti-reverse rotation valve.

Referring now to FIG. 6, a fourth alternate embodiment of an anti-reverse rotation valve is illustrated and generally designated by the numeral 180. The valve 180 includes a generally cylindrical tubular housing 182 for receiving a ball closure member 172, as illustrated. The housing 182 includes a first part 184 adapted to be force fitted into the counterbore 31*a* of shaft 30 and a second part 186 which extends at an acute angle with respect to the first part 184 and with respect to the axis of rotation 31*e* of the shaft 30. The housing part 186 includes plural, radial fluid discharge ports 188 formed therein and a reduced diameter portion forming a seat 190 for the closure member 172. Accordingly, the valve 180 is responsive to rotation of the shaft 30 to move the closure member 172 from its position shown in engagement with seat 190 toward the distal end of housing section 186 for engagement with an end wall 192 thereby opening the ports 188 for communication with the passage 31. A restricted fluid bypass passage 193 is formed in housing section 184, as shown. The housing 182 may be die formed from thin walled metal tubing and suitably closed at distal end 195 after insertion of closure member 172 therein. The valve 180 also enjoys the benefits of the other embodiments of the present invention and may be adapted to be fitted to drive shaft 30 without modification thereto and in place of the valves 80 or 120. Thanks to the configuration of valve 180, including orientation of the ports 188, during rotation of the shaft 30 and flow of a gas-liquid mixture therethrough, separation of gas from liquid in the chamber 48 is further enhanced.

Figure 7:
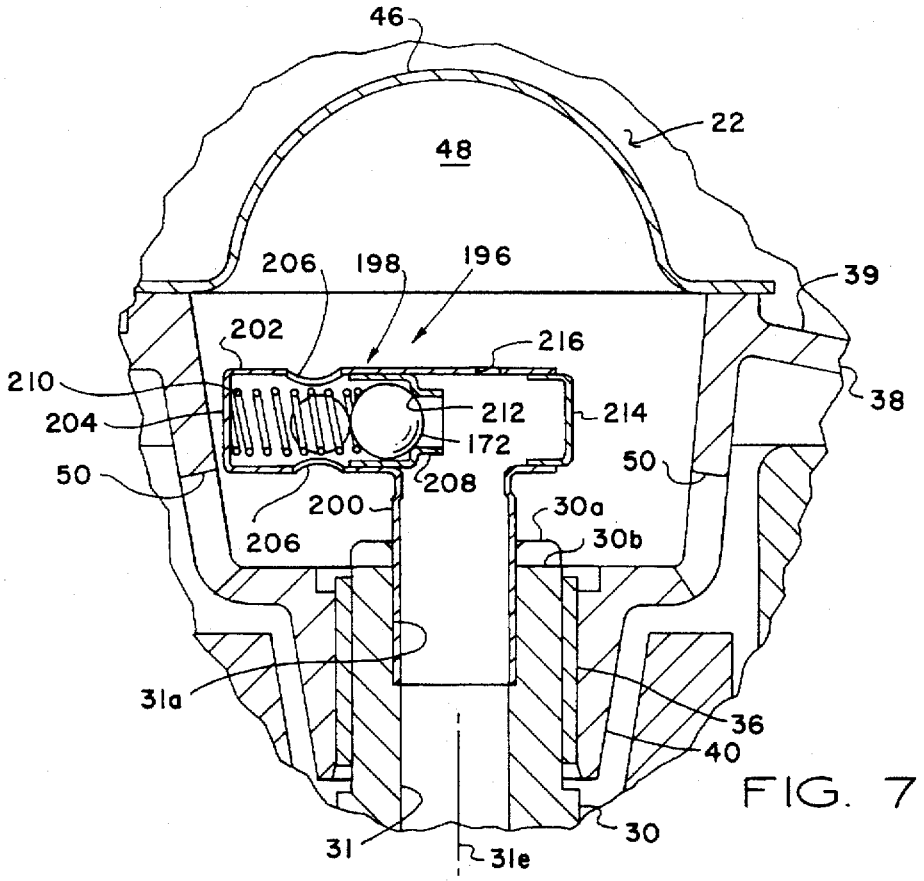
FIG. 7 is a detail section view showing a fifth alternate embodiment of an anti-reverse rotation valve.

Referring now to FIG.7, a fifth alternate embodiment of an anti-reverse rotation valve is illustrated and generally designated by the numeral 196. The valve 196 includes a tubular metal housing 198 including a first cylindrical base portion 200 adapted to be force fitted into counterbore 31a of drive shaft 30 and in communication with passage 31. Housing 196 includes a second cylindrical portion 202 extending at substantially right angles to the housing portion 200. Housing portion 202 includes a transverse end wall 204 and opposed circumferentially spaced and radially extending fluid discharge ports 206 formed therein, as illustrated. A cylindrical tubular seat member 208 is press fitted in the housing portion 202 for retaining a ball closure member 172 in the housing portion 202 together with a coil biasing spring 210 engageable with the closure member to hold the closure member in a valve closed position against a seat surface 212. The housing 198 is closed at an end opposite the end 210 by a suitable cap 214 which, along with seat member 208, may be force fitted in or welded to housing portion 202. The closure member 172, in its seated position shown in FIG.7, is also disposed laterally from the axis of rotation **31*e* of the shaft 30**.

Accordingly, in response to rotation of the shaft 30, the closure member 172 is operable to move to a valve open position, shown by the alternate position lines, against the bias of spring 210. Still further, pressure fluid flowing through passage 31 and the interior of housing 198 will act on the ball closure member 172 to bias it away from its seat 212 to allow fluid to flow through the discharge ports 206. A suitable pressure fluid bleed passage 216 is formed in the housing section 202 to allow pressure fluid to flow from chamber 48 into the passage 31 to eventually equalize the pressure in the chambers 22 and 24, as described above for the other embodiments of the invention. As with all of the embodiments of the invention, the aforementioned bleed passages may also be formed by a suitable groove in the seat surfaces for the closure members of the respective embodiments of the anti-reverse rotation valve.

Figure 8:
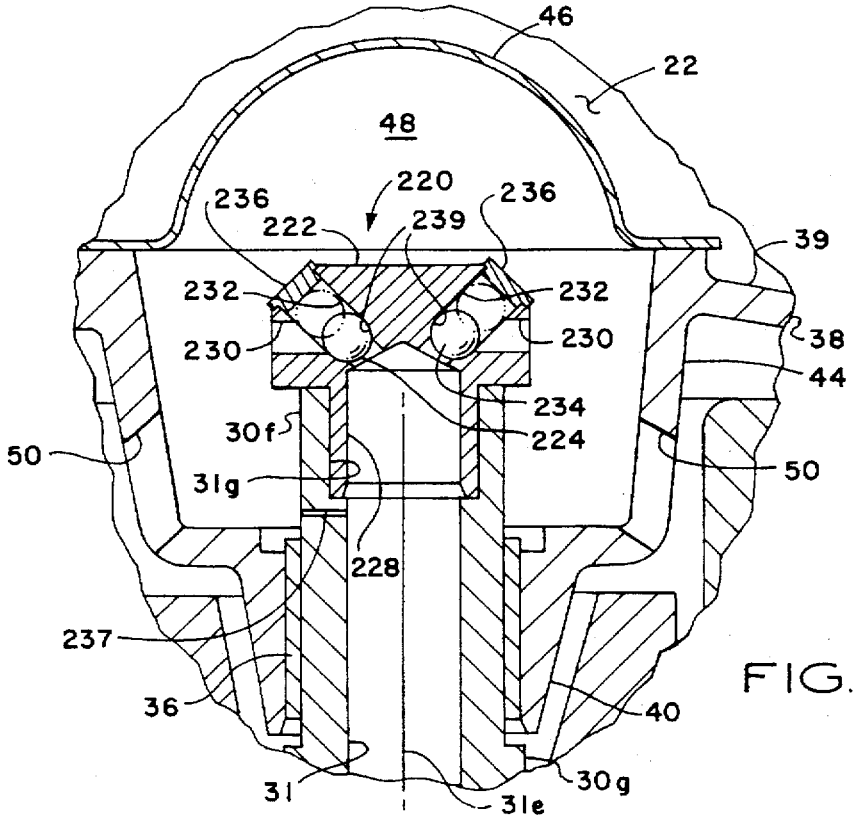
FIG. 8 is a detail section view showing a sixth alternate embodiment of an anti-reverse rotation valve in accordance with the invention.

Referring now to FIGS. 8, a sixth alternate embodiment of an anti-reverse rotation valve in accordance with the invention is illustrated and generally designated by the numeral 220. The valve 220 includes a valve body 222 having a reduced diameter base portion 224 adapted to be suitably secured to a distal end **30*f* of a modified shaft 30*g* having an axial passage 31 therein and rotatable about central axis 31*e*. The housing portion 224 may be press-fitted or threadedly engaged with the shaft distal end portion 30*f* and is shown press fitted in a counterbore 31*g*. The valve housing 222 includes a central axial passage 228 in communication with passage 31 and spaced apart radially extending discharge ports 230 which intersect elongated bores 232 for receiving respective ball-type closure members 234. The bores 232 extend at acute angles, respectively, with respect to axis 31*e* and are closed by suitable end caps 236. The closure members 234 are operable to engage spaced apart valve seats 239, respectively, which are adjacent the passage 228 for receiving pressure fluid flow therethrough to unseat the closure members 34 together with the centrifugal forces acting thereon to allow pressure fluid to flow through the ports 230 into the chamber 48. Since each of the closure members 234 is radially or laterally offset with respect to the shaft axis of rotation 31*e*, when engaged with the seats 239, centrifugal forces acting thereon due to rotation of the shaft 30*g* will unseat the closure members along with the pressure forces acting thereon. If the shaft 30*g* is oriented vertically as illustrated and described, the closure members 234 will tend to close under the force of gravity if the shaft ceases to rotate and also due to pressure differential forces acting thereon. Alternatively, coil springs, not shown, may be interposed between the end caps 236 and the closure members 234 to bias them in the valve closed position. A pressure equalization passage 237 is formed in the shaft distal end part 30*f*, as illustrated in FIG. 8, and communicates the chamber 48 with the passage 31. The valve 220** enjoys all of the benefits of the other embodiments of the anti-reverse rotation valve described hereinabove.

The operation of the improved anti-reverse rotation valves described above is believed to be understandable from the descriptions of the various embodiments. The various embodiments of the anti-reverse rotation valve, as well as the components of the scroll compressor, may be constructed using conventional engineering materials for such machines and for high pressure check valves exposed to refrigerant fluids and conventional lubricating oils for refrigeration compressors. Although preferred embodiments of the invention have been described in detail, those skilled in the art will recognize that various substitutions and modifications may be made without departing from the scope and spirit of the invention as recited in the appended claims.

What is claimed is:

1. In a scroll-type gas compressor;

a pair of interacting scroll members forming compression chambers;

an elongated drive shaft drivably connected to one of said scroll members, said drive shaft including an elongated high pressure gas discharge passage extending therethrough from said one scroll member toward a distal end of said drive shaft, said discharge passage being in fluid flow receiving communication with one of said compression chambers, a bore extending within said drive shaft from said distal end and in communication with said discharge passage; and an anti-reverse rotation valve mounted on said drive shaft at said distal end and including an elongated, generally cylindrical tubular valve housing having one end disposed in said bore in said drive shaft, said valve housing having a cylindrical sidewall and a first transverse end wall at least partially closing an end of said valve housing opposite said one end, a plurality of fluid discharge ports extending through said sidewall and circumferentially spaced apart about the circumference of said sidewall for discharging pressure fluid from said discharge passage through said discharge ports into a high pressure chamber in said compressor, and a closure member disposed in said valve housing and being slidable therein between an open position disposed between said discharge ports and said first end wall and a closed position disposed between said discharge ports and said discharge passage to substantially prevent the flow of pressure fluid from said high pressure chamber to said compression chambers.

2. The invention set forth in claim 1 wherein:

said first end wall comprises a die formed portion of said valve housing forming a re-entrant edge delimited by a circular opening therein.

3. The invention set forth in claim 1 wherein:

said valve housing is supported on said drive shaft by an interference fit of said valve housing with said bore.

4. The invention set forth in claim 1 wherein:

said closure member is formed of a polymer selected from a group consisting of polyether ether ketone, polyamide amid and polyphenal sulfide polymer.

5. The invention set forth in claim 1 including:

a valve seat formed by a second transverse end wall of said valve housing.

6. The invention set forth in claim 1 including:

a valve seat formed by a transverse surface on said drive shaft.

7. The invention set forth in claim 1 including:

a valve seat formed on a generally cylindrical ring member interposed between said drive shaft and said valve housing.

8. The invention set forth in claim 1 including:

a baffle disposed around said valve housing and spaced therefrom for deflecting a gas liquid mixture being discharged from said discharge ports for separating gas from liquid.

9. The invention set forth in claim 1 wherein:

said valve housing includes a portion disposed to extend at an acute angle with respect to said axis of rotation and having said discharge ports formed therein.

10. The invention set forth in claim 1 including:

means defining pressure equalization passage means for equalizing pressure across said closure member.

11. The invention set forth in claim 10 wherein:

said pressure equalization passage means is formed in said closure member.

12. The invention set forth in claim 10 wherein:

said pressure equalization passage means is formed in said valve housing.

13. The invention set forth in claim 1 wherein:

said valve housing includes a portion supporting said closure member which is disposed laterally with respect to an axis of rotation of said drive shaft and said closure member is responsive to centrifugal forces imposed thereon during rotation of said drive shaft to move from a closed position toward an open position.

14. The invention set forth in claim 13 wherein:

said valve housing includes a portion extending laterally with respect to said axis of rotation and supporting said closure member in a closed position laterally spaced from said axis of rotation and spring means disposed in said valve housing and engageable with said closure member to bias said closure member toward a valve closed position.

* * * * *